US007137365B2

(12) United States Patent
Maslen

(10) Patent No.: US 7,137,365 B2
(45) Date of Patent: Nov. 21, 2006

(54) RADIAL ENGINE

(76) Inventor: Desmond Jay Maslen, 604 Cabbage Tree Road, Williamtown, NSW (AU) 2318

( * ) Notice: Subject to any disclaimer, the term of this patent is extended or adjusted under 35 U.S.C. 154(b) by 0 days.

(21) Appl. No.: 10/512,122

(22) PCT Filed: Apr. 24, 2002

(86) PCT No.: PCT/AU02/00513

§ 371 (c)(1),
(2), (4) Date: Jan. 30, 2006

(87) PCT Pub. No.: WO02/088524

PCT Pub. Date: Nov. 7, 2002

(65) Prior Publication Data

US 2006/0137630 A1 Jun. 29, 2006

(30) Foreign Application Priority Data

Apr. 27, 2001 (AU) ..... PR 4625

(51) Int. Cl.
*F02B 75/22* (2006.01)
*F02B 75/32* (2006.01)

(52) U.S. Cl. ..... 123/54.1; 123/197.1

(58) Field of Classification Search ..... 123/54.1–54.8, 123/197.1

See application file for complete search history.

(56) References Cited

U.S. PATENT DOCUMENTS

| | | | | |
|---|---|---|---|---|
| 793,270 | A | 6/1905 | Biorngren | |
| 1,177,609 | A | 4/1916 | Edwards | |
| 1,594,045 | A * | 7/1926 | Harold | 123/54.3 |
| 1,630,273 | A * | 5/1927 | Nordwick | 123/54.3 |
| 1,667,213 | A | 4/1928 | Marchetti | |
| 1,730,659 | A * | 10/1929 | Johnson et al. | 123/54.3 |
| 1,829,780 | A * | 11/1931 | Beytes et al. | 123/54.3 |
| 1,931,401 | A * | 10/1933 | Baisden | 123/54.3 |
| 2,407,859 | A | 9/1946 | Wilson | |
| 3,572,209 | A * | 3/1971 | Aldridge et al. | 123/54.3 |
| 3,687,117 | A | 8/1972 | Panariti | |
| 3,895,614 | A | 7/1975 | Bailey | |
| 4,084,555 | A | 4/1978 | Outlaw | |
| 4,381,740 | A * | 5/1983 | Crocker | 123/54.3 |
| 4,465,042 | A | 8/1984 | Bristol | |
| 4,510,894 | A | 4/1985 | Williams | |
| 4,545,336 | A * | 10/1985 | Waide | 123/55.3 |
| 4,727,794 | A | 3/1988 | Kmicikiewicz | |

(Continued)

FOREIGN PATENT DOCUMENTS

EP 0 064 726 B1 7/1985

(Continued)

OTHER PUBLICATIONS

Zamaratskii Yu I Jan. 6, 1999—1999RU-100540—Piston Machine-.

*Primary Examiner*—Noah P. Kamen
(74) *Attorney, Agent, or Firm*—Woodard, Emhardt, Moriarty, McNett & Henry LLP

(57) ABSTRACT

A radial engine includes an engine block (2) having a central aperture (14). A drive shaft (7) extends through the aperture and a planar cam plate (5,6) is fixedly mounted on the shaft. A pair of spaced opposed walls (25) extend from the surface of the plate. A reciprocatable piston (37) is slidably mounted within a cylinder (9). A cam follower is engaged with at least one of the walls (25), such that reciprocation of the piston (37) rotates the plate (5,6) and the shaft (7).

11 Claims, 6 Drawing Sheets

U.S. PATENT DOCUMENTS

| | | | | |
|---|---|---|---|---|
| 4,782,801 | A | 11/1988 | Ficht et al. | |
| 4,951,618 | A | 8/1990 | Wilson | |
| 5,146,880 | A | 9/1992 | Mayne | |
| 5,279,209 | A | 1/1994 | Mayne | |
| 5,529,029 | A | 6/1996 | Rowe et al. | |
| 5,553,574 | A | 9/1996 | Duncalf | |
| 5,606,938 | A | 3/1997 | Rowe | |
| 5,890,462 | A | 4/1999 | Bassett | |
| 6,035,733 | A | 3/2000 | Yoshizawa | |
| 6,691,648 | B1 * | 2/2004 | Beierle | 123/54.3 |
| 2001/0017122 | A1 | 8/2001 | Fantuzzi | |

FOREIGN PATENT DOCUMENTS

| | | | |
|---|---|---|---|
| FR | 2602002 | A * | 1/1988 |

* cited by examiner

RADIAL ENGINE

FIELD OF THE INVENTION

The present invention relates to engines and particularly to radial engines. It has been developed primarily for use as an internal combustion engine in which the pistons are configured to drive the crank. However, it will be appreciated that the invention is not limited to this particular field of use.

BACKGROUND OF THE INVENTION

The following discussion of the prior art is intended to present the invention in an appropriate technical context and allow its significance to be properly appreciated. Unless clearly indicated to the contrary, however, reference to any prior art in this specification should not be construed as an admission that such art is widely known or forms part of common general knowledge in the field.

There are various known radial engines. A radial engine generally has a crankshaft and pistons disposed in a radial relationship about the crankshaft. The pistons are disposed to engage the crankshaft such that there is correspondence between the rotation of the crankshaft and the reciprocating motion of the pistons in their cylinders.

In one known radial engine, the crankshaft is substituted by a crank that is configured to permit the pistons to be aligned with one another along the length of the rotational axis of the crank. As the pistons are aligned, the normal stepped-waveform crankshaft configuration cannot be used. Usually this is substituted by a cam-and-follower arrangement to permit a translation between the linear reciprocating motion of the pistons and the rotational motion of the crank. It will be appreciated that, due to the alignment of the pistons, this arrangement provides a significantly greater degree of compactness than in the case of engines where the pistons are positioned at spaced intervals along the length of the crankshaft.

However, due to the usual cam-and-follower arrangements, such radial engines have disadvantages relating to the reaction forces exerted by the cranks on the pistons, via the followers and connecting rods. Further disadvantages relate to the methods adopted for effecting suitable engagement between the followers and the cranks. For example, certain of these engines have required cranks with particularly complex structures and complex means for providing lateral support to the connecting rods. Such structures are expensive and difficult to produce and hence are often not suitable for large-scale production.

SUMMARY OF THE INVENTION

It is an object of the present invention to overcome or ameliorate one or more of the disadvantages of the prior art, or to provide a useful alternative.

Accordingly, the invention provides a radial engine including:

an engine block having a central aperture;

a drive shaft extending through the aperture;

a spaced pair of cam plates rotationally fixed with respect to each other, the plates being fixedly mounted on the shaft;

each cam plate including a planar face, the planar face of one cam plate opposing the planar face of the other cam plate;

the opposing faces each including a pair of spaced opposing walls defining a substantially "figure 8" shaped continuous loop, the walls on one the face being aligned with the walls on the opposing face;

at least one cylinder fixed with respect to the block and extending outwardly from the block;

a reciprocatable piston slidably mounted within the cylinder;

a connecting rod fixedly connected at one end to the piston and having an opposing free end;

a slider bearing located on the free end of the connecting rod, the slider bearing engaging with a guide for guiding the slider bearing during reciprocation of the piston; and a cam follower engaged with the walls of each cam plate, wherein reciprocation of the piston rotates the plates and the drive shaft.

Preferably, the guide for the slider bearing is defined by a radially extending bore in the engine block and sidewalls of the bore laterally support the slider bearing during reciprocation of the piston.

Preferably, the cam follower is a pin. More preferably, the pin is included on a linear slider bearing fixedly connected to the free end of the connecting rod. Even more preferably, the slider bearing includes a prismatic body having an aperture for mounting the pin.

Preferably each the substantially "figure 8" shaped continuous loop is defined by a groove in each the plate and the cam follower projects into each the groove.

The engine preferably includes a guide for translationally guiding the connecting rod. More preferably, the guide is defined by a complementary bore in the block, the bore having a sidewall for laterally supporting the connecting rod during reciprocation of the piston.

Preferably, the engine includes an even number of the cylinders, regularly circumferentially spaced around the periphery of the engine block.

In another embodiment, the walls define a projecting ridge on each plate, which in turn define the loop, and the cam follower includes channels into which the ridges extend, the follower being configured to traverse the ridges to rotate the plates.

BRIEF DESCRIPTION OF THE DRAWINGS

Preferred embodiments of the invention will now be described by way of example only, with reference to the accompanying drawings in which.

DETAILED DESCRIPTION OF THE PREFERRED EMBODIMENTS

Figure 11:
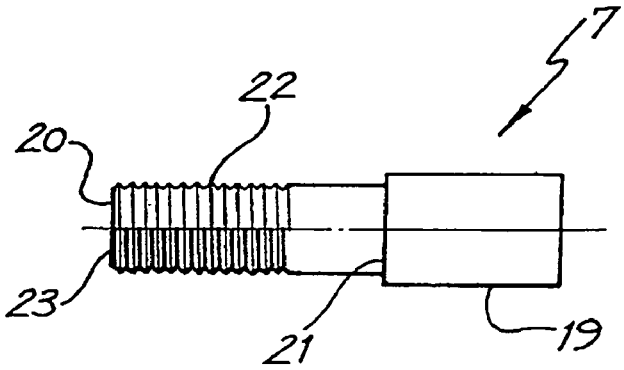
FIGS. 11 and 12, 13 and 14, 15 and 16, and 17 and 18, are side elevations and end elevations, respectively, of various components of the engine of FIG. 1.
Figure 12:
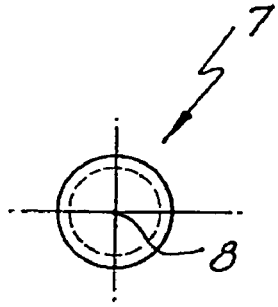
Figure 13:
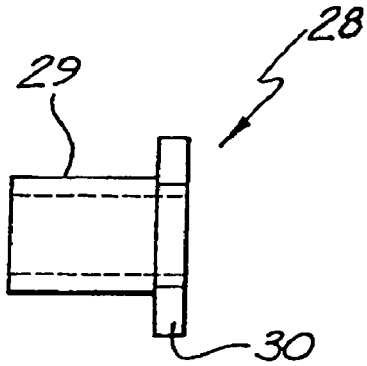
Figure 14:
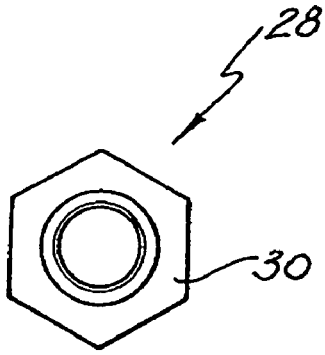
Figure 15:
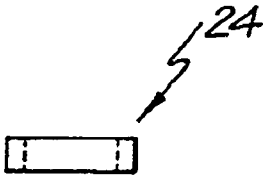
Figure 16:
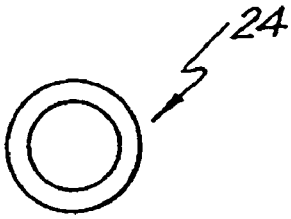
Figure 17:
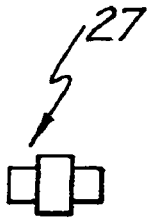
Figure 18:
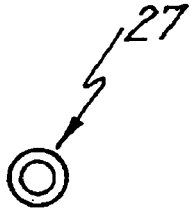

Referring to FIGS. 1 to 18 of the drawings and according to a first embodiment of the invention, a radial engine 1 includes an engine block 2 with a circular recess 3 on each side of the block, and a web 4 dividing the recesses. Each one of a pair of cam plates 5 and 6 is supported on a cylindrical shaft 7 (see especially FIGS. 11 and 12) for rotation about an axis 8. Each plate 5 and 6 is spaced on an opposite side of the web and is accommodated in a respective one of the recesses 3. Eight cylinders 9 are regularly circumferentially spaced around the periphery of the engine block and fixedly connected to the engine block. The cylinders extend radially outwardly with respect to the axis from adjacent the plates. For the sake of simplicity, the cylinder heads and the fuel/air intake manifolds have been omitted from the drawings.

The plates 5 and 6 are substantially enclosed within the recesses 3 by a pair of engine block covers 10 and 11. The engine block 2 and the covers 10 and 11 are fixed with respect to each other by Allen screws 12 which pass through holes 13 in the covers and block. The skilled addressee will appreciate that the parts of the engine described above may be of various materials, including, where appropriate, brass, steel, or aluminium. Furthermore, the parts may, as appropriate, be cast or machined. The cylinders 9, in one embodiment, are bolted to the engine block 2, although in other embodiments the cylinders may be cast or machined to be integral with the engine block.

The engine block 2 has a circular central aperture 14. Each one of a plurality of bores 15 of generally circular cross-section extends radially from the outer rim 16 of the engine block 2 to the central aperture 14. The bores 15 are defined by sidewalls 17, and have a cross-sectional diameter greater than the thickness of the web 4. Accordingly, the sidewalls have gaps that open through the opposite outer surfaces of the web to define a longitudinal slot 18.

The shaft 7 has a cylindrical broad shaft-portion 19 and a cylindrical narrow shaft-portion 20. The narrow shaft-portion 20 is of smaller diameter than the broad shaft-portion 19 so that there is a shoulder 21 between the portions. The narrow shaft-portion 20 includes a radially outer screw thread 22 that extends from a free end 23 of the narrow shaft-portion towards a position closer to the shoulder 21.

The plates 5 and 6 are disposed to face each other with the web 4 between them. Moreover, the plates 5 and 6 are spaced apart by a spacer 24 (see especially FIGS. 15 and 16) that extends through the central aperture 14 of the engine block 2.

Each plate includes a pair of spaced opposed walls 25 extending from the plate surface to define a continuous loop. In this embodiment, the walls are parallel and extend into the plate to define a substantially "figure 8" shaped groove 26 in the plate, as illustrated in FIG. 9. In this embodiment, the grooves are machined into or formed on their respective plates. In alternative embodiments (not shown), the plate includes a recess, the perimeter of the recess defining the outer wall of the groove. In these alternative embodiments, a complementary second plate member fits within the aperture to define the inner wall of the groove.

In another embodiment of the invention (not shown), the walls extend outwardly from the plate surface to define a protruding continuous ridge and the cam follower includes a channel into which the ridge extends, the follower being configured to traverse the ridge as the plate rotates.

The plates are rotationally fixed with respect to each other by locating pins 27 (see FIGS. 17 and 18) disposed inside the perimeter of the grooves 26, such that the grooves are aligned with each other.

A locking element 28 (see especially FIGS. 13 and 14), having a spigot-shaped portion 29 and a nut 30, is screwed onto the screw-threaded end 22 of the narrow shaft portion 20. The nut 30 is secured against the plate 5 to hold both plates captive against the shoulder 21. In one embodiment, the plates 5 and 6 are constrained to rotate with the shaft 7 by means of a key and keyway (not shown). In another embodiment, this is achieved by means of splines (also not shown).

The engine block cover 11 has a socket-shaped portion 31 that defines a central aperture 32 through which the broad shaft-portion 7 extends as a running fit.

The other engine block cover 10 has a stepped-socket-shaped portion 33 that has a larger-diameter part 34 and a smaller-diameter part 35. The larger-diameter part 34 accommodates the nut 30 of the locking element 28. The smaller-diameter part 35 defines a central aperture 36 through which the spigot-shaped portion 29 of the locking element 28 extends as a running fit.

It will be appreciated that rotation of the plate 5 about the axis 8 is enabled by the running fits of the spigot-shaped portion 29 of the locking element 28 and the broad shaft-portion 7 in the apertures 36 and 32, respectively. In a further embodiment (not shown) the spigot-shaped portion 29 and the broad shaft-portion 7 may be provided with bearings to facilitate rotation of the plates 5 and 6. Furthermore, seals (not shown) may be provided to retain lubricant at positions where one surface rotates on another.

A reciprocatable piston 37 is slidably mounted within each cylinder 9. Each piston moves along a respective straight piston axis 38. Axes 38 each extend radially outwardly perpendicular to the crank axis 8 and lie in a common plane. One side of each piston 37 forms part 39 of a combustion chamber. On the other side of each piston 37, there is attached one end 40 of a connecting rod 41. The connecting rods 41 extend along the complementary bores 15 in the engine block and are laterally supported by the sidewalls 17. It will therefore be understood that the connecting rods 41 are angularly immovable relative to the respective piston axes 38.

Each connecting rod 41 has an opposite free end 42 and an aperture 43 adjacent the free end. A respective cam follower in the form of a pin 44, is located in each aperture 43. Each pin 44 has opposite free ends and a central portion between the ends. The central portion of each pin is located in the apertures and the pin free ends project through the slot 18 and into the groove 26.

In use, each piston 37 is powered in a manner conventionally employed in internal combustion engines (although the cylinder heads and the intake and exhaust valves and/or ports are not shown in the drawings). The resulting reciprocating motion of the pistons 37 along their respective piston axes 38 involves corresponding motion of the connecting rods 41. It should be noted that the slots 18 extend substantially parallel to the respective piston axes 38. Thus, when the pistons 37 reciprocate, the free ends of the cam-follower pins 44 traverse the slot 18 and cammingly engage the walls 25. In the present, preferred embodiment, each pin 44 has a shoe at each of its free ends for engaging and guiding the pin along the walls 25. However, in another embodiment (not shown) each pin 44 is equipped with a roller for rolling along the walls 25.

The timing of the piston movement and the specific configuration of the grooves 26 are such that the pistons 37, via the connecting rods 41, drive the plates 5 and 6 in rotation about the crank axis 8, with the walls 25 acting as cam surfaces in engagement with the cam follower pins 44.

Figure 19:
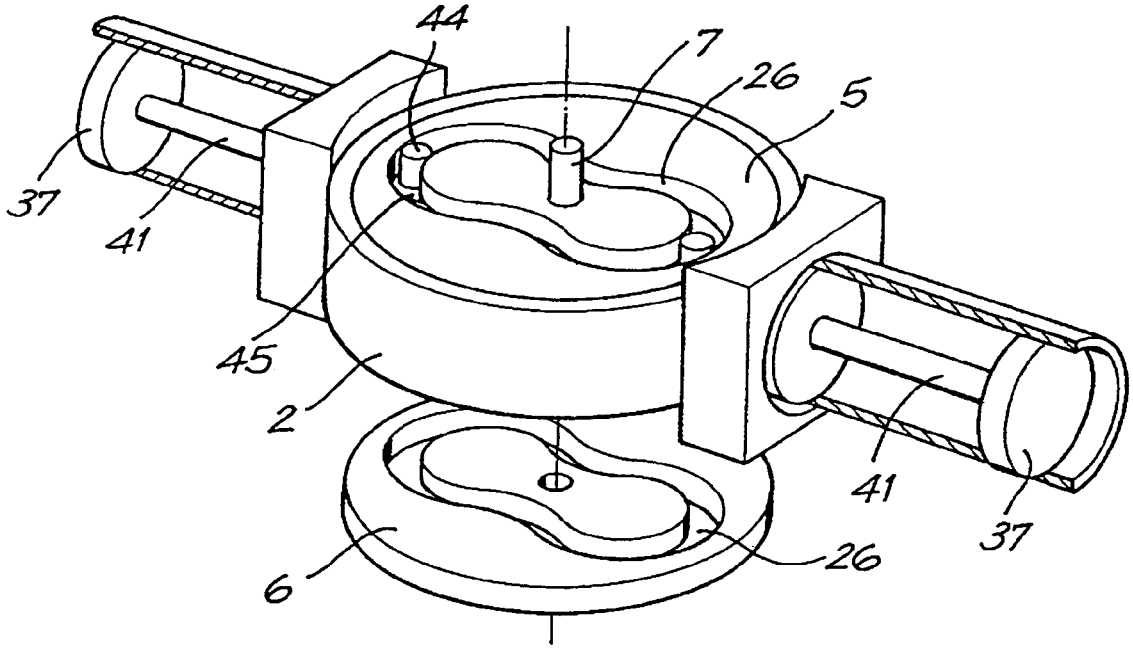
FIG. 19 is a part-exploded perspective view of another embodiment of an engine according to the invention.
Figure 20:
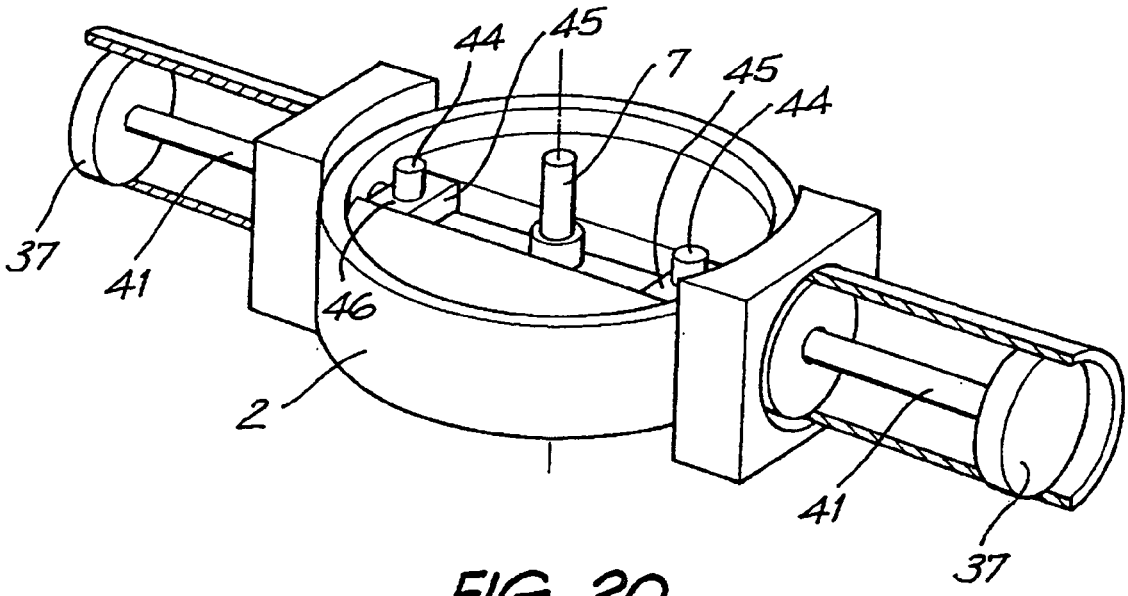
FIG. 20 is a perspective view of the engine of FIG. 19, shown with the cam plates removed.
Figure 21:
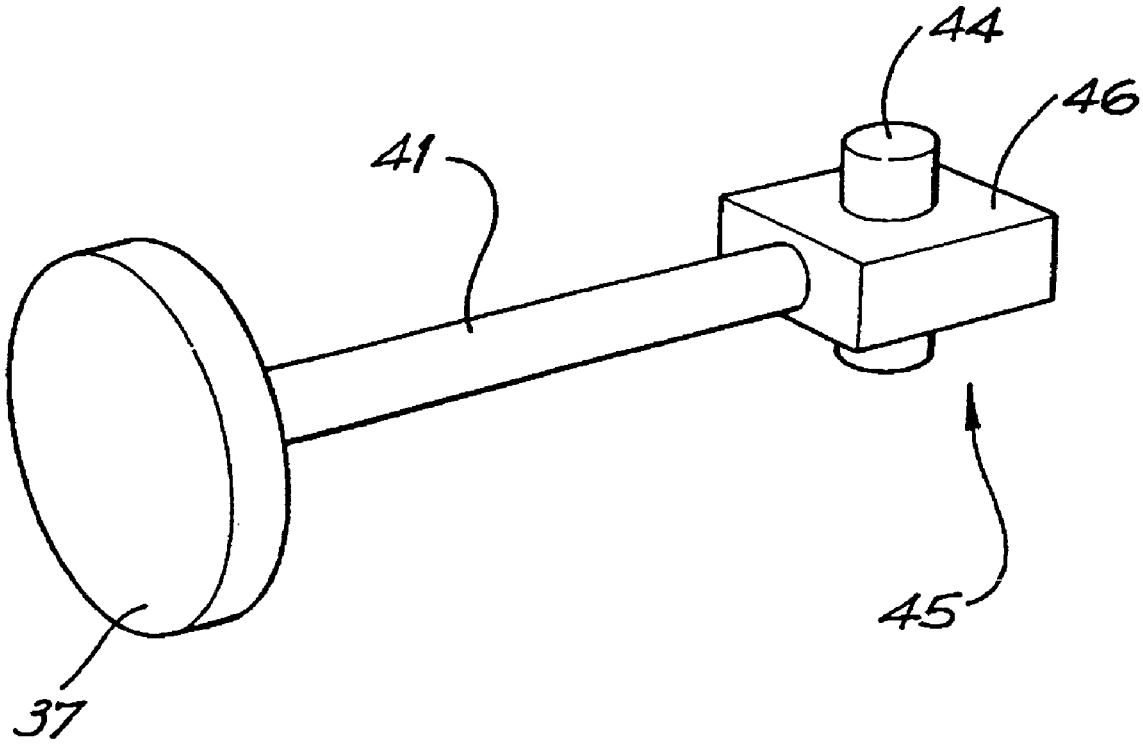
FIG. 21 is a perspective view of the linear slider bearing of FIGS. 19 and 20.

An alternative embodiment of the invention is illustrated in FIGS. 19, 20 and 21, where corresponding reference numerals indicate corresponding features. For the sake of simplicity, a two-cylinder embodiment is shown with the cylinder heads and the fuel/air intake manifolds omitted. The grooves are shown as slots extending completely through the cam plates to enable ease of understanding of the assembly.

This embodiment functions essentially in the same manner as the embodiment described above. However, in this embodiment, a linear slider bearing 46 is fixedly connected to the free end of each connecting rod 41. The bearing includes a prismatic body 45 having an aperture (not shown) through which a respective one of the pins 44 extends. Each one of the pins extends beyond the extent of the body and into the plate grooves 26. The bores 15 in the engine block are complementary with the shape of the bearings and extend completely through the web 4 to define a slot 49. Therefore, the bores have sidewalls perpendicular to the plane of the web. This configuration simplifies manufacture of the engine block, while maintaining the lateral support for the connecting rods.

The configuration of the engine 1 in the embodiments described above is such that it is suitable for use as a two-stroke engine or a four-stroke engine.

Because the connecting rods 41 are guided in the bores 15, the lateral reaction forces exerted by the plates 5 and 6 on the cam-follower pins 44 is not communicated to the pistons 37. Accordingly there is no specific requirement for the pistons 37 to be capable of withstanding the bending moments that may occur in conventional engines. Therefore, the piston skirts present in conventional engines can be reduced in length or omitted entirely, as in the embodiment being described.

Where the engine 1 is used as the type of two-stroke engine where the fuel-air mixture is drawn into the area below the piston, because the connecting rods do not move from side-to-side as in a conventional two-stroke engine and because of the shorter or omitted skirts, a greater degree of compression can occur on the fuel-air mixture below the piston. Without wishing to be bound by theory, the applicant believes that, where a compression to 6 psi might be achieved in the case of a conventional two-stroke engine, a compression to 150 psi is achievable using an engine in accordance with an embodiment of the present invention.

Generally, if the exhaust port were lowered in a two-stroke engine of the type being discussed, this would be advantageous in one sense, as it would prolong the power stroke, with a resulting increased torque. However, in another sense, it would be disadvantageous as it would delay the evacuating of exhaust gases, which would in turn reduce the ability to transfer fuel-air mixture from below the piston to the combustion chamber. This effect would be particularly significant in cases where high engine revolution rates were required. The greater compression permitted by an engine according to an embodiment of the present invention would, however, increase the potential rate of transfer of fuel-air mixture from the area below the piston to the combustion chamber. As the resulting forcing of fuel-air mixture into the combustion chamber would also force the burnt gases out through the exhaust port, the effect of delaying the exhausting of spent gases would be offset. Accordingly, embodiments of the present invention lend themselves to lowering the ports, with the associated advantage of longer power strokes and higher torque, without the disadvantage of reduced rate of transfer of gases.

In addition to the above, the shorter or omitted skirts would result in the pistons being lighter than those in conventional engines. The use of lighter pistons in conjunction with the radial configuration would reduce or eliminate the need for counter-weights or crankshaft bob weights which may be required in conventional engines to achieve suitable balancing. The lighter pistons would also reduce stresses, and the power losses associated with overcoming inertia.

A further advantage of the arrangement envisaged by the present invention is that the grooves 26 could be configured for each piston 37 to reach top dead centre twice for every single revolution of the plates 5 and 6 and hence of the output shaft 7. This may permit greater compactness, as the stroke would effectively be doubled without increasing the physical size of the engine.

It will be appreciated that the features of the present invention, at least in preferred embodiments, provide an effective way of achieving the cam-and-follower structure required for a radial engine of the present type. Notable among these features are the opposed walls 25 which form an integral part of the cam plates 5 and 6, the grooves 26 defined by these walls, the bores 15 in the engine block 2 and the slots 18 in the sidewalls 17 through which the cam follower pins 44 extend. These features provide a relatively simple balance between, on the one hand, the desired conversion from translational motion of the pistons 37 to rotational motion of the crank with the pistons being aligned with one another for compactness, and on the other hand, effective lateral support of the connecting rods 41 and minimisation of bending moments on the pistons.

An advantage of the engine according to an embodiment of the invention is that the cylinders are arranged in opposed pairs and therefore provide for a natural balancing of the engine. It will be appreciated that, although 8 cylinders are shown in the described example, other multiples of two cylinders can be used instead.

The invention is described above as an internal combustion engine in which the pistons are configured to drive the cam plates. However, it will be appreciated that the invention is not limited to this particular application. For example, the engine may be configured so that the plates are driven by a prime mover, with the plates in turn driving the pistons in their reciprocating motion. Such a construction may constitute, for example, a pump apparatus where each piston constitutes an individual pump.

Although the invention has been described with reference to a specific embodiment it will be appreciated by those skilled in the art that it may be embodied in many other forms.

Figure 1:
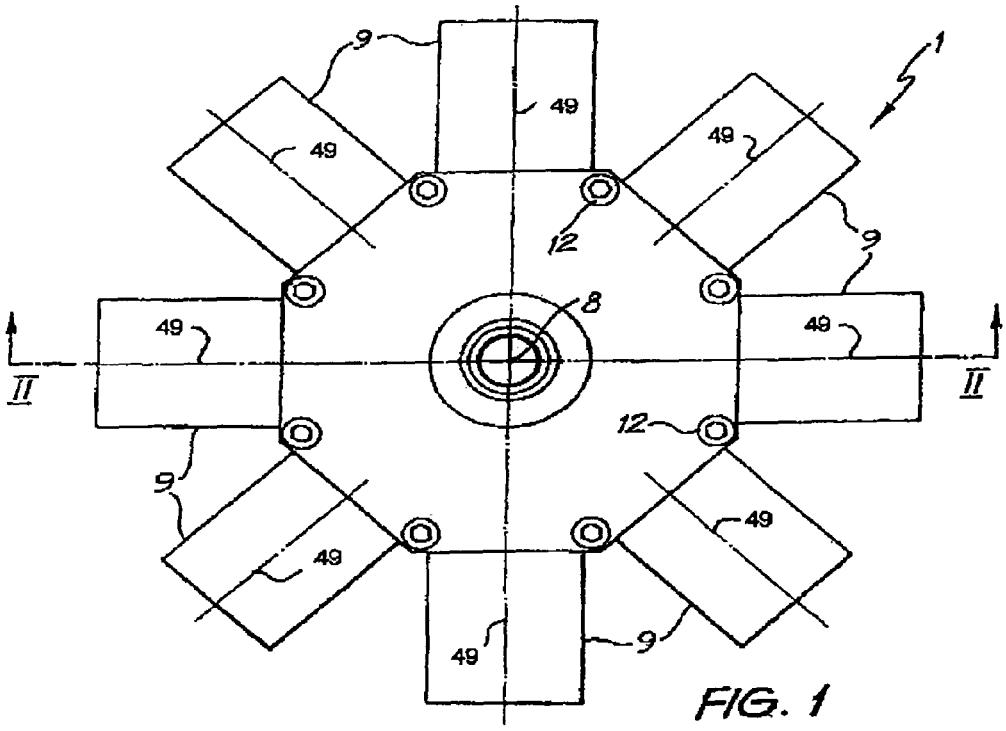
FIG. 1 is a side elevation of an engine according to an embodiment of the present invention.
Figure 2:
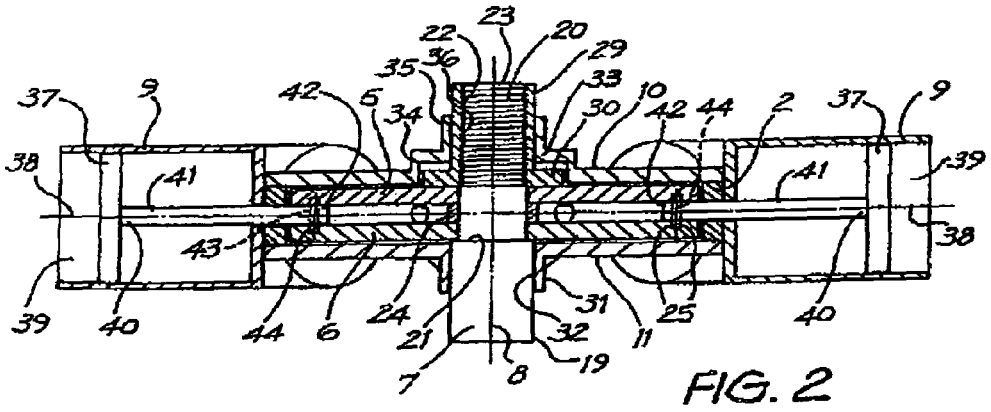
FIG. 2 is an elevation of the engine of FIG. 1 in the direction of arrow II.
Figure 3:
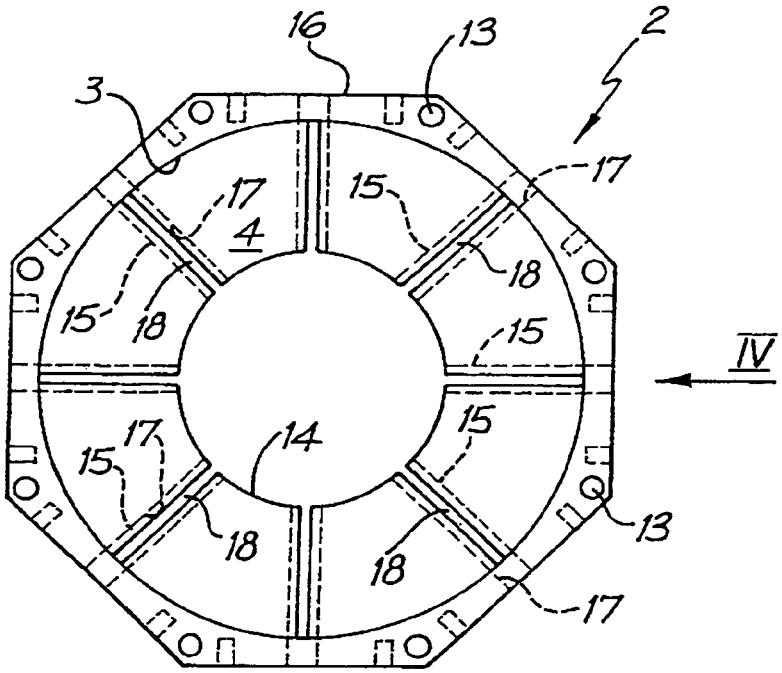
FIG. 3 is a side elevation of an engine block of the engine of FIG. 1.
Figure 4:
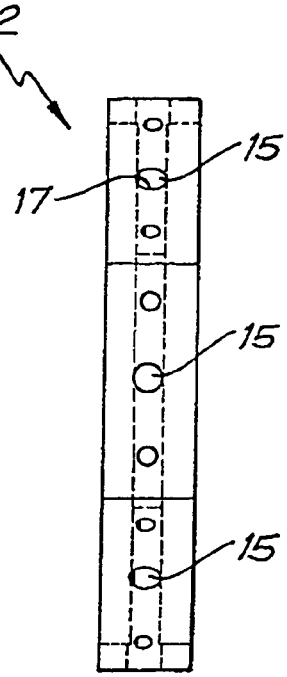
FIG. 4 is an elevation of the block of FIG. 3 in the direction of arrow IV.
Figure 5:
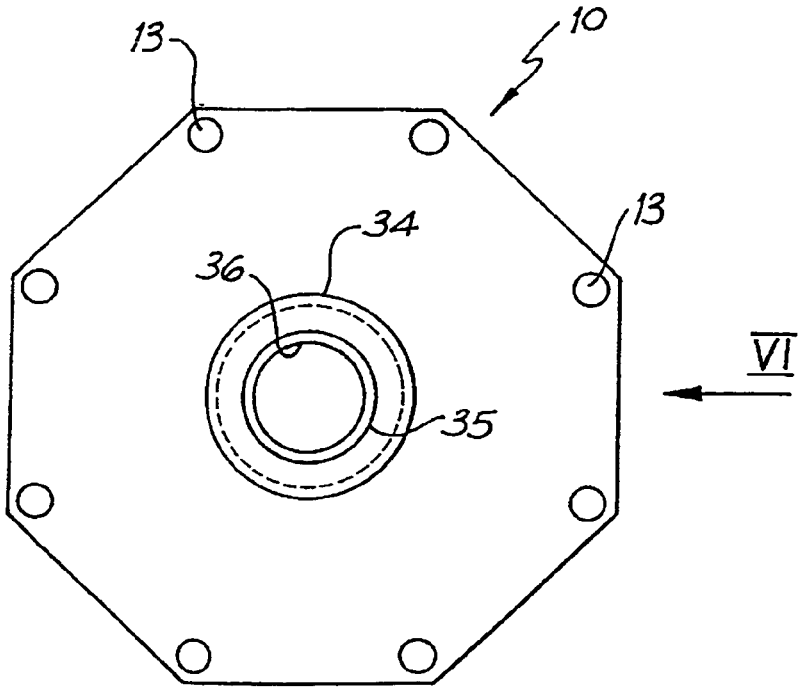
FIG. 5 is a side elevation of an engine block cover forming part of the engine of FIG. 1.
Figure 6:
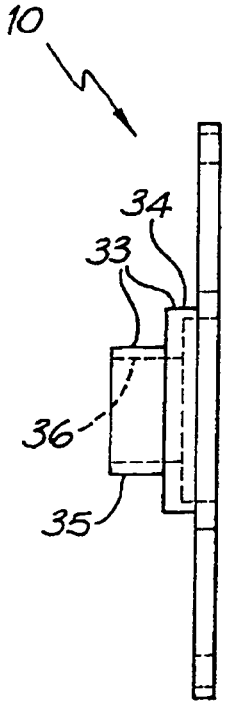
FIG. 6 is an elevation of the cover of FIG. 5 in the direction of arrow VI.
Figure 7:
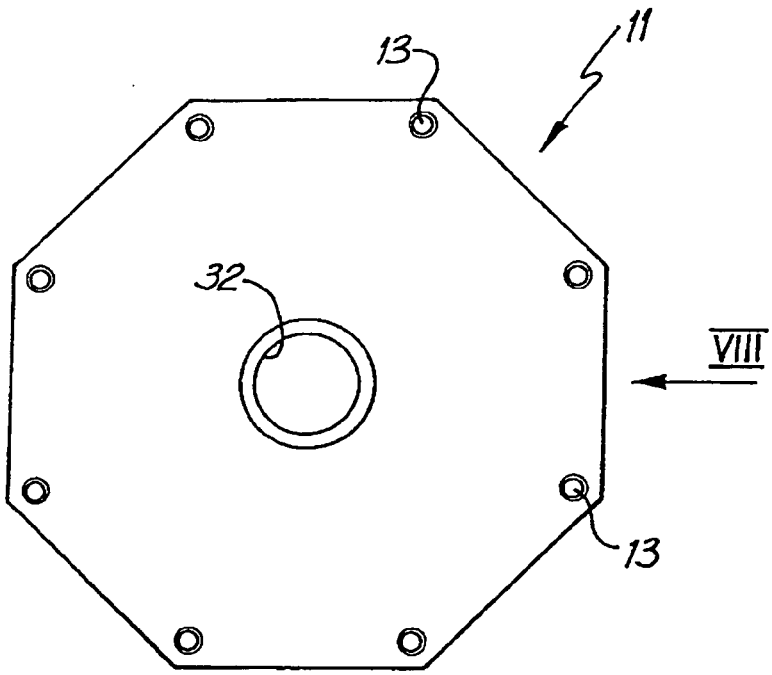
FIG. 7 is a side elevation of a further engine block cover forming part of the engine of FIG. 1.
Figure 8:
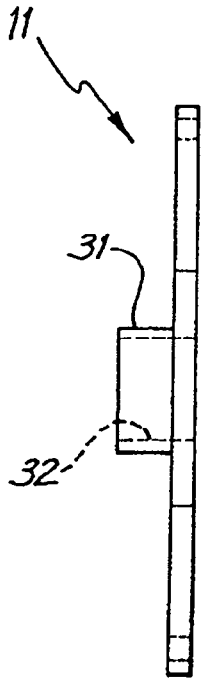
FIG. 8 is an elevation of the cover of FIG. 7 in the direction of arrow VIII.
Figure 9:
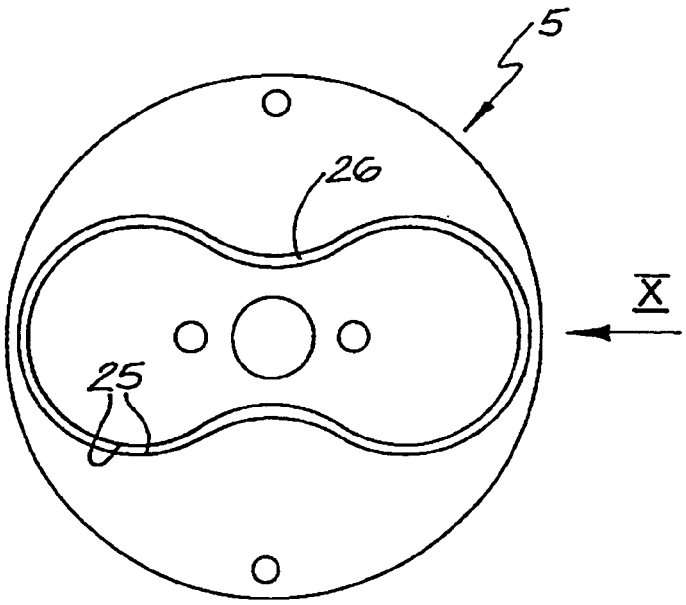
FIG. 9 is a side elevation of part of a crank forming part of the engine of FIG. 1.
Figure 10:
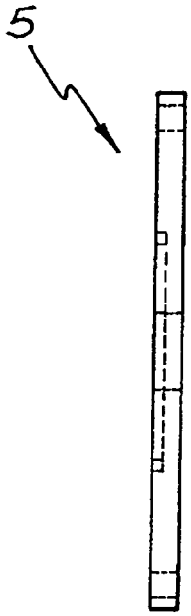
FIG. 10 is an elevation of the part of FIG. 9 in the direction of arrow X.

The invention claimed is:

1. A radial engine including:

an engine block having a central aperture;

a drive shaft extending through said aperture;

a spaced pair of cam plates rotationally fixed with respect to each other, the plates being fixedly mounted on said shaft;

each cam plate including a planar face, the planar face of one cam plate opposing the planar face of the other cam plate;

the opposing faces each including a pair of spaced opposing walls defining a substantially "figure 8" shaped continuous loop, the walls on one said face being aligned with the walls on the opposing face;

at least one cylinder fixed with respect to said block and extending outwardly from said block;

a reciprocatable piston slidably mounted within said cylinder;

a connecting rod fixedly connected at one end to said piston and having an opposing free end;

a slider bearing located on said free end of said connecting rod, said slider bearing engaging with a guide for guiding said slider bearing during reciprocation of said piston; and a cam follower engaged with said walls of each cam plate, wherein reciprocation of said piston rotates said plates and said drive shaft; and wherein said guide is defined by a radially extending bore in said engine block and sidewalls of said bore laterally support said slider bearing during reciprocation of said piston.

2. A radial engine as claimed in claim 1 wherein said cam follower is located on said slider bearing.

3. A radial engine as claimed in claim 1 wherein said cam follower is a pin.

4. A radial engine as claimed in claim 1 wherein each said substantially "figure 8" shaped continuous loop is defined by a groove in each said plate and said cam follower projects into each said groove.

5. A radial engine as claimed in claim 1 further including a guide for translationally guiding said connecting rod.

6. A radial engine as claimed in claim 1 wherein said cam follower includes a roller for rolling engagement with said walls.

7. A radial engine as claimed in claim 1 wherein said engine includes a plurality of said cylinders.

8. A radial engine as claimed in claim 7 including an even number of said cylinders, regularly circumferentially spaced around the periphery of said engine block.

9. A radial engine including:

an engine block having a central aperture;

a drive shaft extending through said aperture;

a spaced pair of cam plates rotationally fixed with respect to each other, the plates being fixedly mounted on said shaft;

each cam plate including a planar face, the planar face of one cam plate opposing the planar face of the other cam plate;

the opposing faces each including a pair of spaced opposing walls defining a substantially "figure 8" shaped continuous loop, the walls on one said face being aligned with the walls on the opposing face;

at least one cylinder fixed with respect to said block and extending outwardly from said block;

a reciprocatable piston slidably mounted within said cylinder;

a connecting rod fixedly connected at one end to said piston and having an opposing free end;

a slider bearing located on said free end of said connecting rod, said slider bearing engaging with a guide for guiding said slider bearing during reciprocation of said piston; and a cam follower engaged with said walls of each cam plate, wherein reciprocation of said piston rotates said plates and said drive shaft; and wherein said slider bearing includes a prismatic body.

10. A radial engine including:

an engine block having a central aperture;

a drive shaft extending through said aperture;

a spaced pair of cam plates rotationally fixed with respect to each other, the plates being fixedly mounted on said shaft;

each cam plate including a planar face, the planar face of one cam plate opposing the planar face of the other cam plate;

the opposing faces each including a pair of spaced opposing walls defining a substantially "figure 8" shaped continuous loop, the walls on one said face being aligned with the walls on the opposing face;

at least one cylinder fixed with respect to said block and extending outwardly from said block;

a reciprocatable piston slidably mounted within said cylinder;

a connecting rod fixedly connected at one end to said piston and having an opposing free end;

a slider bearing located on said free end of said connecting rod, said slider bearing engaging with a guide for guiding said slider bearing during reciprocation of said piston;

a cam follower engaged with said walls of each cam plate, wherein reciprocation of said piston rotates said plates and said drive shaft; and, a guide for translationally guiding said connecting rod; and, wherein said guide is defined by a complementary bore in said engine block and the sidewall of said bore laterally supports said connecting rod during reciprocation of said piston.

11. A radial engine as claimed in claim 10 wherein said sidewall includes a longitudinal slot through which said cam follower projects.

* * * * *